US005996885A

United States Patent [19]

Chu

[11] Patent Number: 5,996,885

[45] Date of Patent: Dec. 7, 1999

[54] FOLDABLE TOTE BOX

[75] Inventor: Lawrence H. Y. Chu, Grand Prairie, Tex.

[73] Assignee: Merryland Products, Inc., Grand Prairie, Tex.

[21] Appl. No.: 09/150,402

[22] Filed: Sep. 9, 1998

[51] Int. Cl.[6] ..... B65D 5/30

[52] U.S. Cl. ..... 229/179; 229/191; 229/918

[58] Field of Search ..... 229/177, 178, 229/179, 191, 918

[56] References Cited

U.S. PATENT DOCUMENTS

| | | | |
|---|---|---|---|
| 1,383,929 | 7/1921 | Gereke | 229/179 |
| 2,711,282 | 6/1955 | D'Esposito | 229/179 |
| 2,741,415 | 4/1956 | Meitzen | 229/179 |
| 3,053,429 | 9/1962 | Pierce, Jr. . | |
| 3,059,829 | 10/1962 | Thompson . | |
| 3,073,504 | 1/1963 | Greene et al. | 229/179 |
| 3,093,291 | 6/1963 | Brandle . | |
| 3,105,626 | 10/1963 | McCormick et al. . | |
| 3,185,381 | 5/1965 | Fobiano et al. . | |
| 3,203,619 | 8/1965 | Wilson . | |
| 3,211,358 | 10/1965 | Pierce, Jr. . | |
| 3,226,006 | 12/1965 | Dunn . | |
| 3,310,219 | 3/1967 | Dlugopolski . | |
| 3,310,220 | 3/1967 | Feldman . | |
| 3,471,077 | 10/1969 | Kitchell | 229/179 |
| 3,708,103 | 1/1973 | Evans . | |
| 3,883,067 | 5/1975 | McGlynn et al. | 229/179 |
| 3,908,889 | 9/1975 | Vjeesner . | |
| 3,918,630 | 11/1975 | Meyers . | |
| 3,991,932 | 11/1976 | Curren et al. . | |
| 4,091,985 | 5/1978 | Holzinger . | |
| 4,216,897 | 8/1980 | Collura et al. . | |
| 4,313,555 | 2/1982 | Sieffert . | |
| 4,463,997 | 8/1984 | Densen | 312/260 |
| 4,846,398 | 7/1989 | Johnson | 229/179 |
| 5,121,878 | 6/1992 | Wallin | 229/195 |
| 5,184,772 | 2/1993 | McGrath | 229/179 |
| 5,402,932 | 4/1995 | Fadaie | 229/195 |
| 5,649,663 | 7/1997 | Pestow, Jr. | 229/918 |

*Primary Examiner*—Gary E. Elkins
*Attorney, Agent, or Firm*—Jie Sha

[57] ABSTRACT

A foldable tote box is formed by a one-pierce die-cut and scored board of corrugated material, especially corrugated plastic materials, that includes novel locking system so as to facilitate quick assembly of the box. The board includes a generally rectangular bottom panel, two pairs of side-wall panels to form the side-wall of the tote box, and ore or two pairs of filler beam panels connected to one of the pairs or both pairs of side-wall panels. Each side-wall panel having the filler beam panels includes a side wall section and a flap section, on which two insert locking tabs are formed at appropriate locations to be associated with corresponding fastening tabs located on the filler beam panels. Each of the filler beam panels can be folded to form a hollow support beam. The novel locking system comprises a pair of locking insert tabs is cut out in form of cutting lines on a flap-over section of each end wall panel, and capable of engaging with a pair of holding tabs that is formed, respectively, at predetermined locations on the corresponding filler beam panels, wherein each locking insert tab and a corresponding holding tab are oriented in the same direction when the box is assembled, and the locking insert tab is longer than the holding tab, while the holding tab is wider than the locking insert tab such that the insert tab can be inserted through an opening as the holding tab is pressed away from the filler beam panel during assembling of the box, and the holding tab can hold and lock the locking insert tab upon release of the pressing.

23 Claims, 11 Drawing Sheets

FOLDABLE TOTE BOX

CROSS REFERENCE

This application is an improvement of the foldable tote box disclosed in the U.S. patent application Ser. No. 08/949,174, filed by the same inventor and owned by the same assignee, that is pending.

FIELD OF THE INVENTION

The present invention relates to an improved foldable box or tote box, particularly to a tote box for holding general merchandise and fresh produce. More particularly, the tote box of the present invention is formed of a one-piece board of corrugated materials, especially corrugated plastic materials, and has an improved locking system to facilitate quick assembly of the box and to enhance its stability and strength. A box cover is provided with a similar locking system for quick assembly and stability. The tote box of this invention is designed to be used not only outdoor, such as in the farmland under sunshine, raining, or even snowing weather conditions, but also indoor, such as cold storage or refrigerated transportation of goods, especially fresh produce that should be kept in special environment to preserve their quality.

BACKGROUND OF THE INVENTION

There are many kinds of boxes or cartons known in the art, that are used for holding goods for storage and transportation. These known boxes are made of various materials, such as cardboard, wood, metal, and plastics. However, all of the known boxes have, respectively, various disadvantages, such as moisture immersion, high cost, or too heavy. Particularly, none of the known foldable boxes is suitable for all environmental conditions, such as sunshine or hot environment, wet or humid conditions, cold or frozen conditions, and stacking-up with heavy load. Therefore, there is a need or demand for a durable box which can be used in any kinds of environment in which a box would be used. At the same time, the box must be cost efficient or economical, easily foldable, easily transportable, reusable, light weight, moisture resistant, washable, and capable of stacking-up to bear heavy load for a relatively long period of time. The box should also be recyclable.

At present, no single box can meet all of these requirements. Most of one-piece board of foldable boxes are made of cardboard, waxed cardboard, or thin plastics because thick plastic boards cannot be easily folded. Such boxes usually utilize laminate layers or fillers to reinforce the side and end walls or corners of the box for better support, for instance, the box disclosed in U.S. Pat. No. 3,310,219 to Dlugopolski; However, the locking systems used thereon are not strong enough to hold the box panels together when the box is used in severe conditions, such as moisture, heat, heavy load. The novel locking system of the present invention, however, can meet the requirements of strong holding and quick assembly of the box even when the box is used under the severe conditions.

The normal locking system for the boxes are tab and slot engagements that are not deadly locked. For example, the inset tabs and the slots are used in U.S. Pat. No. 3,310,219 to Dlugopolski, and U.S. Pat. No. 3,708,103 to Evants. The barbed tabs are used in U.S. Pat. No. 4,463,997 to Densen, and U.S. Pat. No. 3,991,932 to Carmel et al. These locks are designed for cardboard material which is relatively soft and flexible. The locking system of Densen is a combination of the tab-slot engagement and barbed tabs. The barbed tabs must be bend over at the box corner to assure the locking of the additional tab-slot engagement. The assembly of such box is relatively slow and such locking cannot be used on boxes of thicker plastic materials. Due to moisture immersion or merely worn-out, the tab-slot engagement or barbed tabs, even the combination thereof in Densen, will be weakened.

Therefore, it is an object of the present invention to provide an improved foldable tote box that meets all requirements stated above.

It is another object of the present invention to provide a novel locking system for foldable boxes, that facilitates the quick assembly or disassembly of the box, while provides the box with enhanced strength and stability.

It is a further object of the present invention to provide a foldable tote box that may have hollow support beams at all four sides for enhancing support strength for stacking-up boxes and providing insulation and cushion functions to absorb impacts.

SUMMARY OF THE INVENTION

In accordance with the present invention, a foldable tote box comprises a one-pierce die-cut board of corrugated material, said board including a rectangular bottom panel having a predetermined length and width defined by its two side edges and two end edges; a pair of side-wall panels, each having a folding edge integrally connected to the side edge of the bottom panel and being folded along a first scored folding line at the folding edge to form the side-wall of the box, said side-wall panel having a top edge opposite to the folding edge and two end edges defining a width of the side-wall panel that defines a height of the box; a pair of filler beam panels connected to the end edges of each side-wall panel, each of said filler beam panels extending from said respective end edge of said side-wall panel and being folded along a second scored folding line at the side-wall panel end edge to form a hollow support beam; a pair of end wall panels respectively integrally connected to and extended from the end edges of the bottom panel and folded along third scored folding lines thereat, each of said end wall panels including a flap section and an end wall section divided by first double scoring lines that define a support surface therebetween, wherein a pair of locking insert tabs is cut out in U-shaped cutting lines on the flap section and engaged with a pair of holding tabs that is formed at predetermined locations on the respective filler beam panels so as to hold the support beams formed of the filler beam panels against the end wall section of the end wall panel when the box is assembled, and wherein each locking insert tab and its corresponding holding tab are oriented in the same direction.

On the top edge of the side-wall panel, there is provided an additional filler beam panel. This additional filler beam panel includes an inner wall portion that is connected to the top edge of the side-wall panel and foldable along second double scoring lines that define a side-wall support surface therebetween, and a pair of side-wall filler beam portions being integrally connected to two opposite end edges of the inner wall portion and foldable along third double scoring lines and foldable to form two hollow support beams for the side-wall of the box. The side-wall hollow support beams are locked between the inner wall portion and the side-wall panel by means of tab and slot engagement. For instance, there is a locking tab formed on an appropriate location along a side of the side-wall filler beam panel, that engages with a notch opening or slot formed on the side-wall support surface between the side-wall panel and the inner wall portion of the additional filler beam panel.

Each of the filler beam panels includes at least three sections proportionally divided by double scoring lines between adjacent sections. A stacking tab may be optionally formed at a top edge of each filler beam panel for the end wall and positioned at one of the three sections. This is disclosed in U.S. Ser. No. 08/949,174 of the same inventor and assignee. There are notch opening or openings at predetermined locations along the scoring lines on the end wall panel so that the tab of the filler beam panel protrudes through the notch opening or openings when the board is folded to form the box. However, instead of providing the stacking tabs on the filler beam panels, such stacking tabs can be formed by the locking tabs on the side-wall panels as discussed above. The stacking holes may be provided adjacent to the end or side edges of the bottom panel of the box. Thus, the stacking tabs of the lower box, either on the end wall or side-wall beams, will engage with the stacking holes of the upper box to lock the upper box in position, i.e., restricting the movement of the upper box in all directions.

The novel locking system includes a locking insert tab or tabs formed on the flap section of the end wall panel to be pressed and inserted through and held by a holding tab or tabs formed on the hollow support beam or beams for the box end wall. The insert tab is oriented somewhat parallel to the free end of the flap section. A corresponding locking insert tab and holding tab are oriented in the same direction as the tabs engage with one another. The insert tab is a cut-out U-shape portion at appropriate location in the flap section. The length of the insert tab is a little bit longer than the holding tab on the support beam. Due to the elasticity of the corrugated board or plastic board, the holding tab on the support beam will hold the insert tab against the wall of the support beam once the insert tab is pressed and inserted through the holding tab which is moved away, by pressing, from its original position and tends to return the original position on the support beam.

Further, a cover piece can be provided with the novel locking system. The cover piece includes nine panels of a top panel, two side panels, two end panels, and four corner panels that are integrally connected to either end panels or side panels. The locking insert tabs are provided on the side panels if the corner panels are connected to the end panels or vice versa. The holding tabs of the locking system are formed on the corner panels.

The present invention can be well understood in the following descriptions in connection with the accompanying drawings.

DETAILED DESCRIPTION OF THE INVENTION

Figure 1:
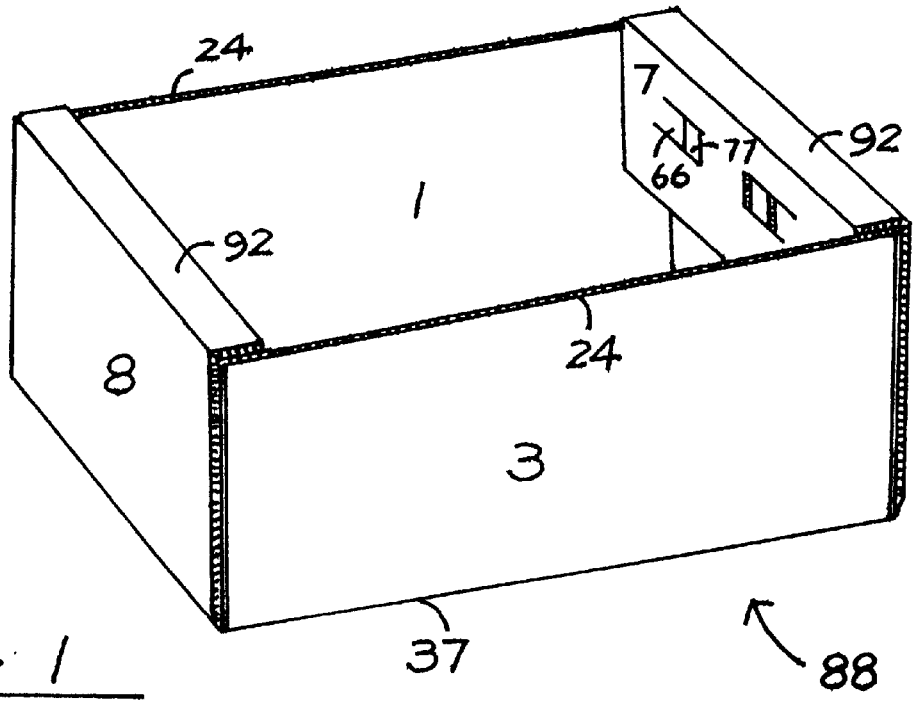
FIG. 1 is a perspective view of a foldable tote box of the present invention, having support beams at two ends or sides and the new locking system.
Figure 2:
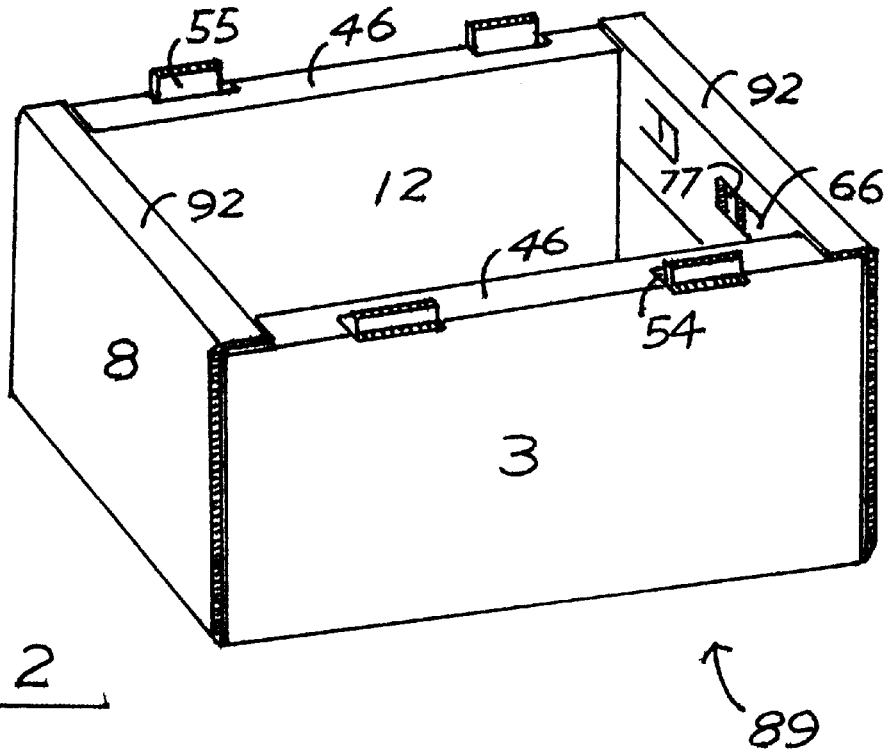
FIG. 2 is a perspective view of a foldable tote box of the present invention, having support beams at all four sides and the new locking system.

FIGS. 1 and 2 generally illustrate the two embodiments of tote box 88 and 89 of the present invention. The box 88 of the first embodiment of the present invention, as shown in FIG. 1, includes a bottom, two side-walls and two end walls that are provided with wide support surfaces 92. On the flap section 7, the locking insert tabs 66 are pressed and inserted through, and engage with the lock holding tabs 77.

FIG. 2 shows a box 89 of the second embodiment of the present invention that has wide support surfaces 92 and 46 at all four sides of the box. The locking tabs 55 protrude through the locking slots 54 at two side walls. It should be understood that the locking tabs 55 are shown in enlarged scales. These locking tabs 55 can be relatively short to be just enough to lock the support beams, while they will not prevent from putting a box cover thereon. The upright locking tabs 55, however, can serve as stacking tabs if the tabs are relatively long as actually shown in FIG. 2. In this situation, the cover to be used thereon must have openings at appropriate locations to let the stacking tabs protrude through.

Figure 3:
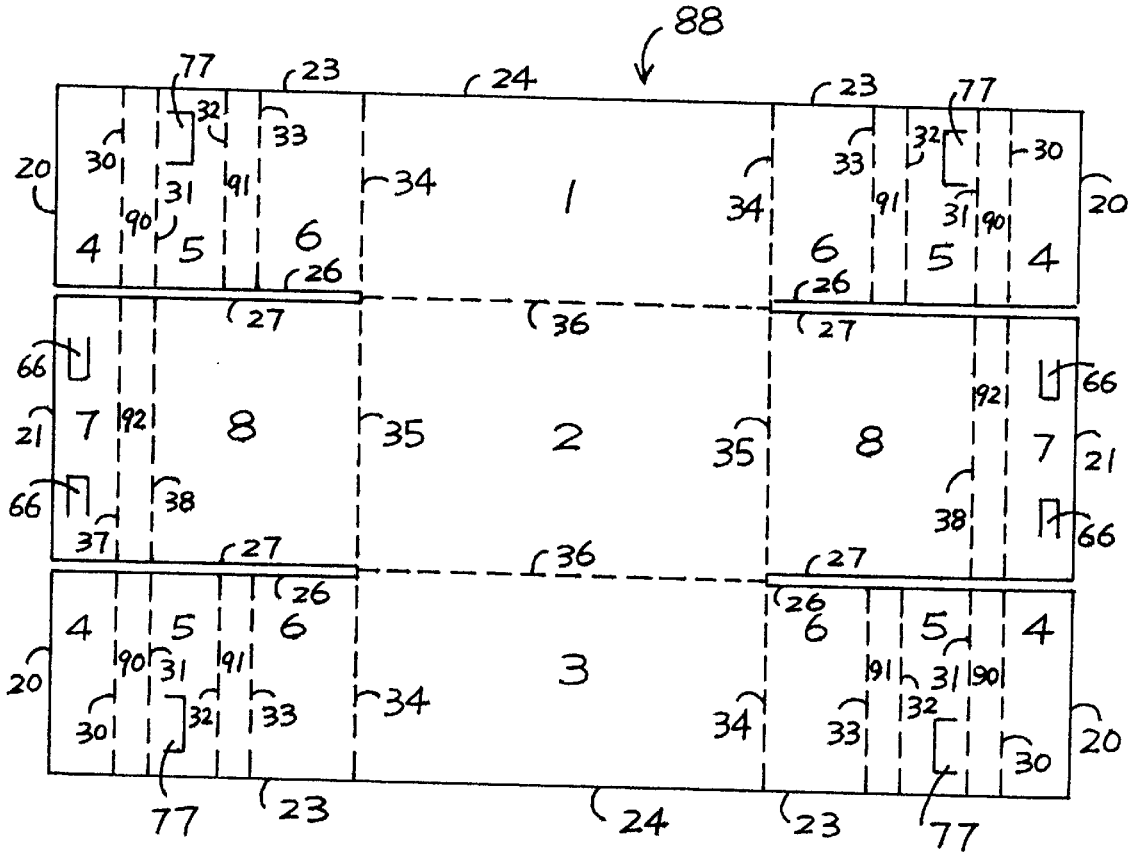
FIG. 3 is a plane view of the foldable tote box board of the present invention with filler beam panels for forming the support beam for two sides or ends.

The tote box 88 of the present invention is constructed by a one-piece die-cut and scored board of corrugated materials, preferably corrugated plastic materials, as shown in FIG. 3. FIG. 3 shows a flat board of unassembled foldable tote box. The board comprises a bottom panel 2 with two end edges and two side edges defining the size of the box, two end wall panels being connected to the end edges and foldable along scoring lines 35 of the bottom panel 2, two side-wall panels 1 and 3 being connected to the side edges and foldable along scoring lines 36 of the bottom panel 2, and four filler beam panels being connected, respectively, to end edges of the side-wall panels 1 and 3, and foldable along scoring lines 34.

Each of the end wall panels has an end wall section 8 and a flap section 7 that are divided by double scoring lines 37 and 38. The double scoring lines 37 and 38 define an end wall support surface 92 of the tote box. A pair of locking insert tabs 66 of the novel locking system are formed by cutting lines on the flap section 7. The locking insert tabs 66 are parallel with the double scoring lines 37 and 38 and point toward one another.

Each of the filler beam panels is divided into three sections of outer beam section 6, inner beam section 5, and insert beam section 4. These sections are divided by two pairs of double scoring lines 30, 31, 32, and 33. Each pair of double scoring lines defines a side beam section 90 or 91. A holding tab 77 of the new locking system is formed by a cutting line on the inner beam section 5 of each filler beam panel. The holding tab 77 on each support beam is oriented in the same direction as the corresponding locking insert tab 66 on the flap section 7 when the box is being assembled.

The die-cut and scored board of the tote box of the present invention is manufactured by die-cutting a piece of corrugated plastic board, that has smooth surfaces on both sides to obtain the bottom panel, end wall panels, side-wall panels, and filler beam panels, and to obtain, at the predetermined locations, all of the scoring lines mentioned above, and the locking insert tabs and holding tabs of the novel locking system as discussed above. If desired, there may be some die-cuts for handle-receptacles and venting apertures.

Figure 4:
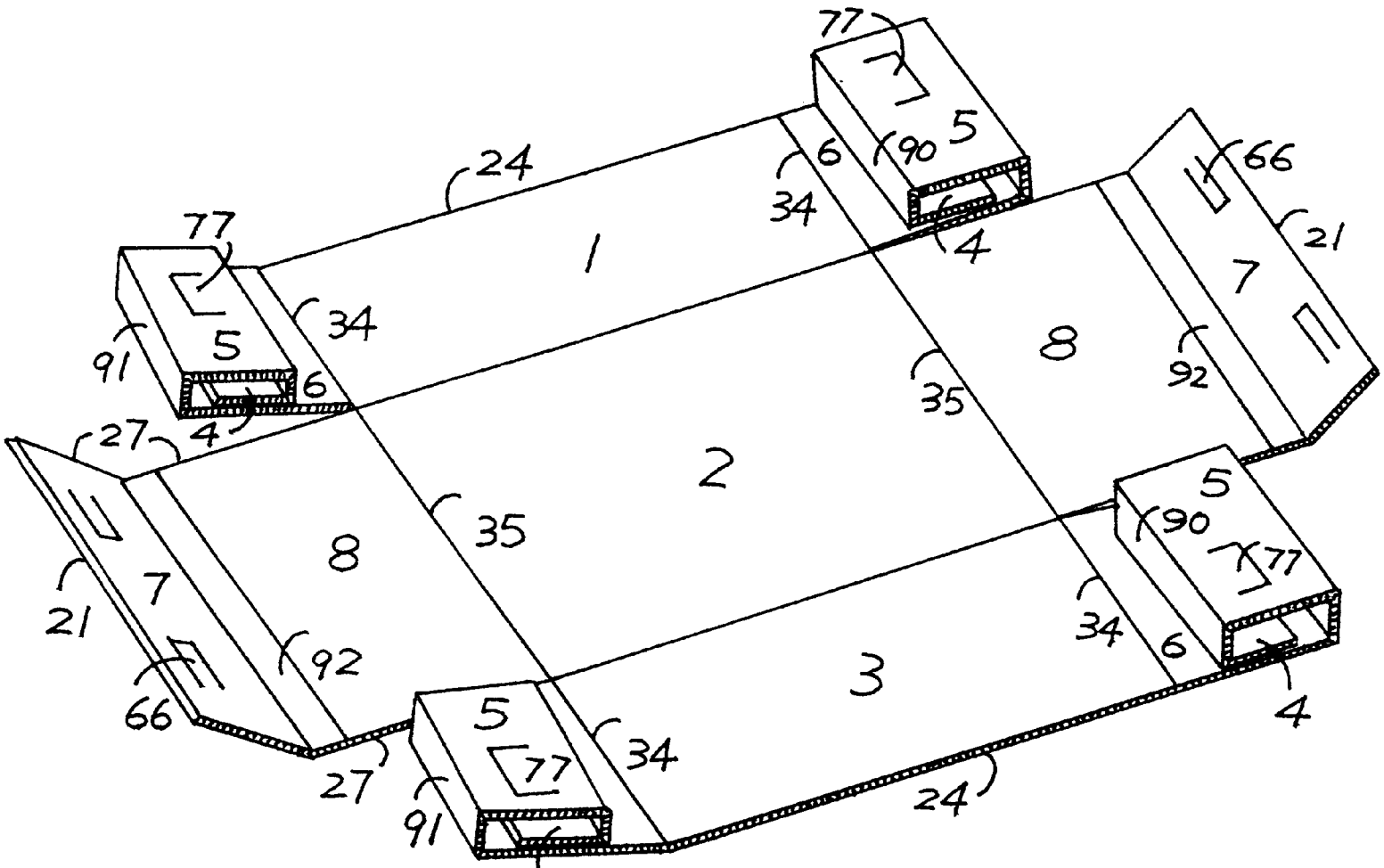
FIGS. 4 and 5 are perspective views showing the assembling process of the box including the formation of support beams by the filler beam panels and the support surfaces by the end wall panels in accordance with the present invention.
Figure 5:
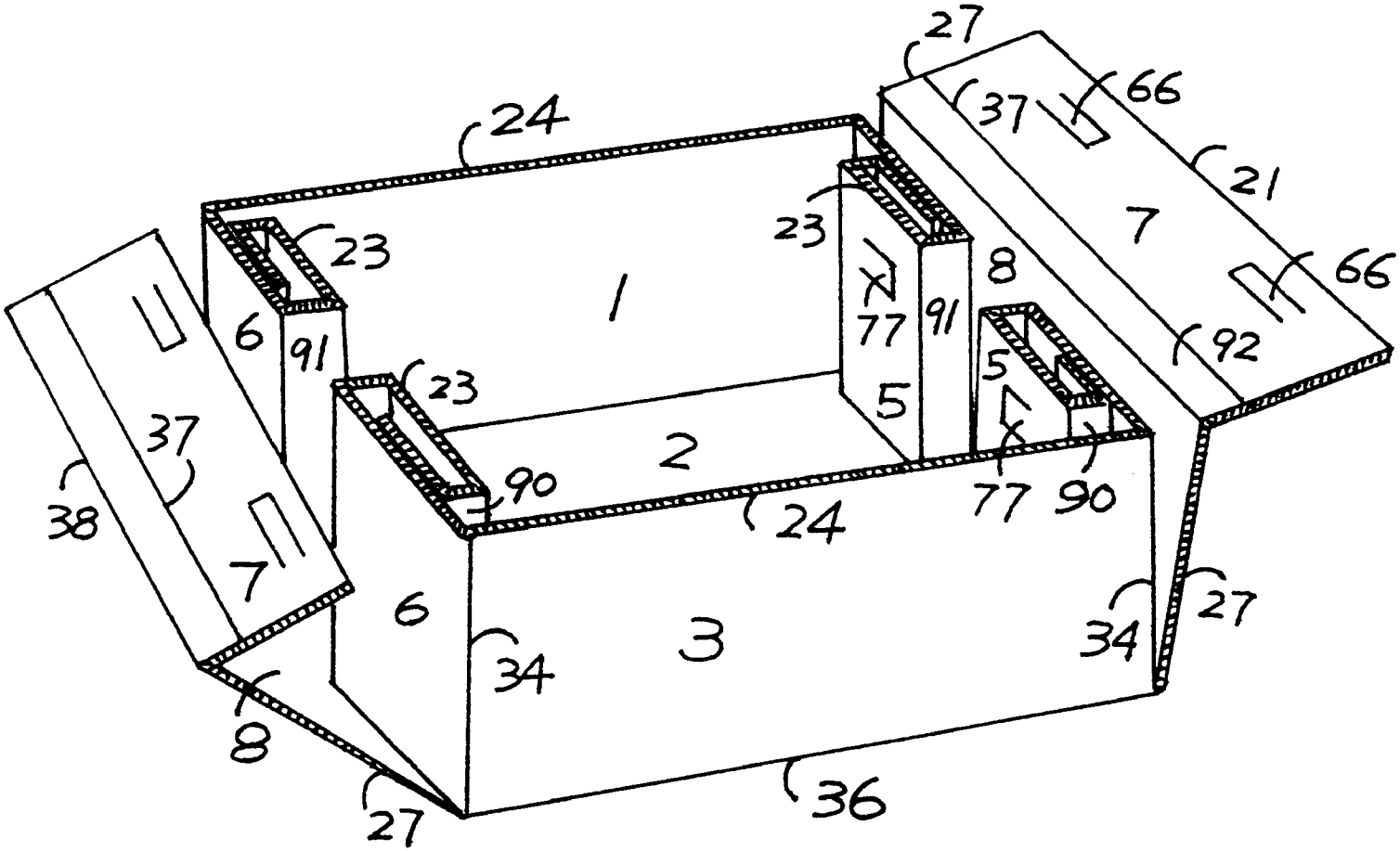
Figure 11:
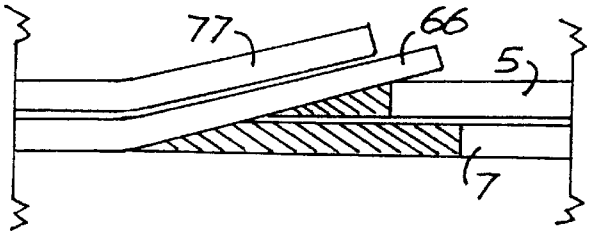
FIGS. 9, 10, 11 and 12 illustrate, respectively, the shape and engagement of the insert tab and holding tab of the new locking system of the present invention.
Figure 12:
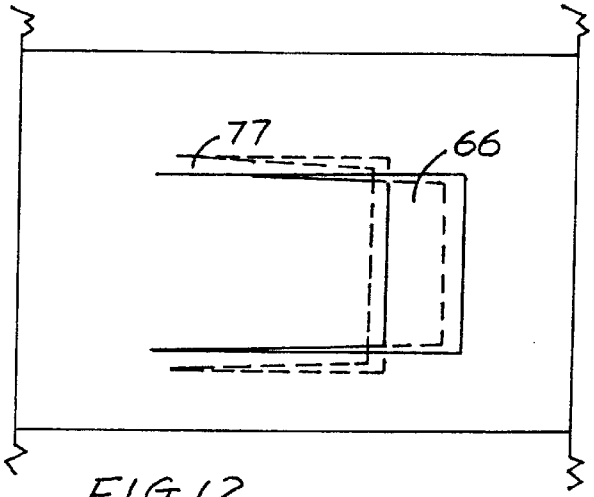

As shown In FIGS. 4 and 5, the filler beams are folded to form hollow support beams with the flutes of the corrugated board oriented vertically when the box is assembled as seen from the sides 23 of the support beams. Each of the end wall panels is folded upward and has the flap section 7 folded over the hollow beams such that the beams are embraced by the flap section 7 against the end wall section. When the flap section is being closed to the hollow beams, the locking insert tabs 66 can be pressed and inserted against the holding tabs 77 on the beams so that the holding tabs 77 are bent inwardly and the insert tabs 66 are inserted into the hollow beams. Due to the elasticity, the tabs 77 and 66 tend to return their original positions, that is, to be flash with the respective surfaces of the inner beam section 5 and flap section 7 once the pressing is released. However, the insert tabs 66 are made a little bit longer than the holding tabs 77, while the holding tabs 77 are a little bit wider than the insert tabs 66. Therefore, once the insert tabs 66 pass through the corresponding holding tabs 77 and get into the respective hollow beams, each insert tab 66 will be held by the holding tab 77 against the inside surface of the corresponding inner beam section 5. Such engagement is illustrated in FIGS. 11 and 12.

Further, as seen in FIG. 5, the flutes of the board at the end wall section are oriented perpendicular to the vertically oriented flutes on the support beams. Thus, the flutes on the locking insert tab 66 and the flutes on the holding tab 77 are also perpendicular with each other such that the engagement of the locking insert tab and the holding tab is reinforced.

Figure 6:
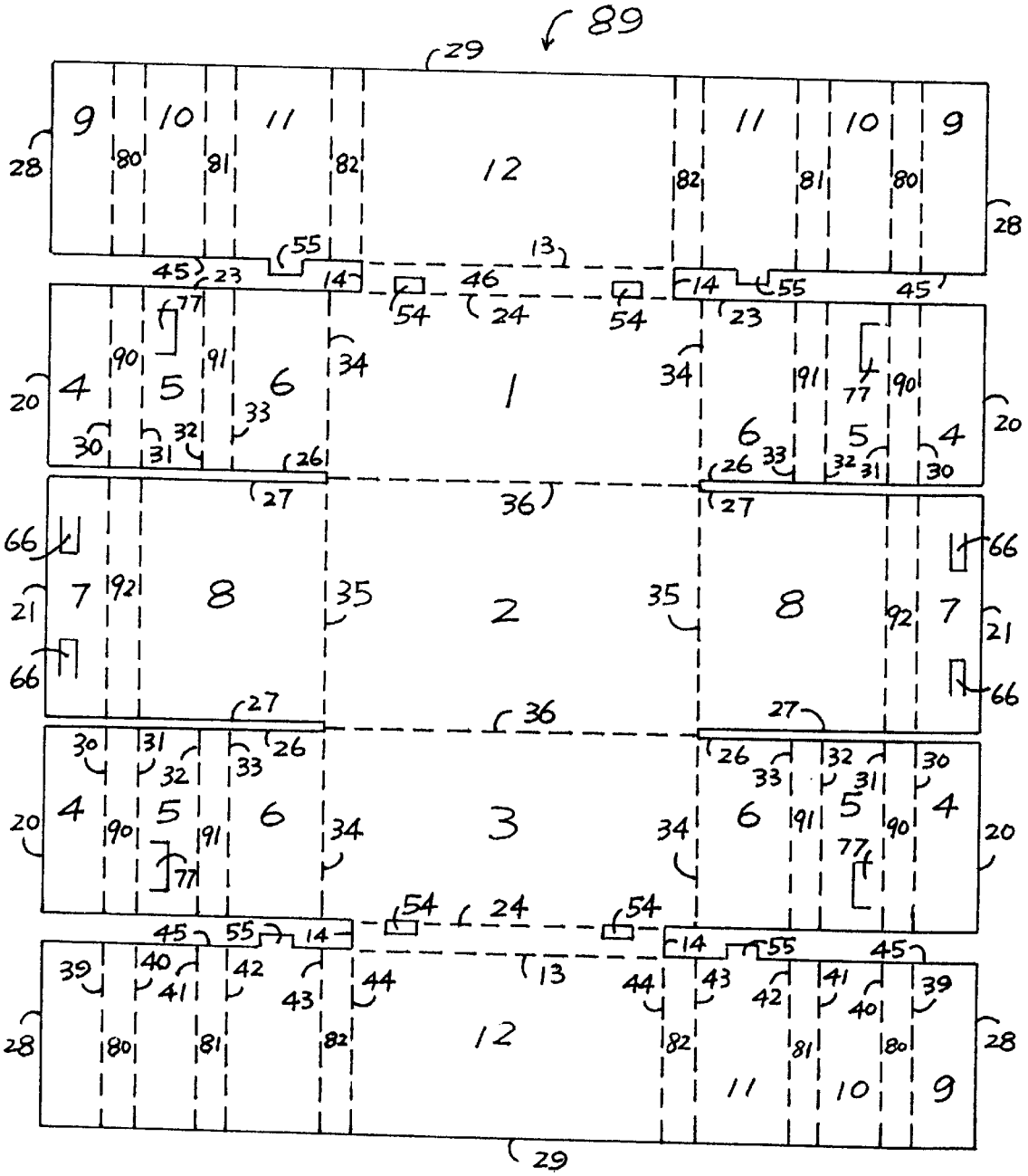
FIG. 6 is a plane view of the foldable tote box board of the present invention with filler beam panels for forming the support beam for all four sides.

Likewise, as seen in FIG. 6, the bottom panel 2 of the box of the second embodiment of the present invention is defined by two scored folding lines 36 on its side edges and two scored folding lines 37 on its end edges. In addition to the above stated end wall panels, side-wall panels, and filler beam panels, there are additional filler beam panels to form side-wall hollow support beams. Each of the additional filler beam panels includes an inner wall portion 12 that is connected to the top edge of the side-wall panel 1 or 3 and foldable along double scoring lines 13 and 24 that define a side-wall support surface 46, and a pair of filler beam portions integrally connected to two opposite end edges of the inner wall portion 12 and being foldable along double scoring lines 43 and 44 to form two hollow support beams for the side-wall of the box 89.

The filler beam portion of the additional filler beam panel includes three sections similar to the three sections of the filler beam panel for the end hollow support beam. The three sections of the additional filler beam are outer beam section 11, inner beam section 10, and insert beam section 9 divided by two pairs of double scoring lines 39, 40, 41, and 42 such that each pair of double scoring lines defines a side beam section 80 or 81. A locking tab 55 is formed at the edge 45 of the filler beam portion, at the outer beam section 11. There are corresponding locking slots 54 formed on the side-wall support surface 46. The side-wall hollow support beams are locked between the inner wall portion and the side-wall panel by means of locking tab and slot engagement. The locking tab 55 may be made a little bit longer such that it serves as a stacking tab. Normally, the locking tab 55 is just made long enough to engage with the locking slot 54 so that the locking tab 55 will not prevent from placement of a box cover thereon.

Figure 7:
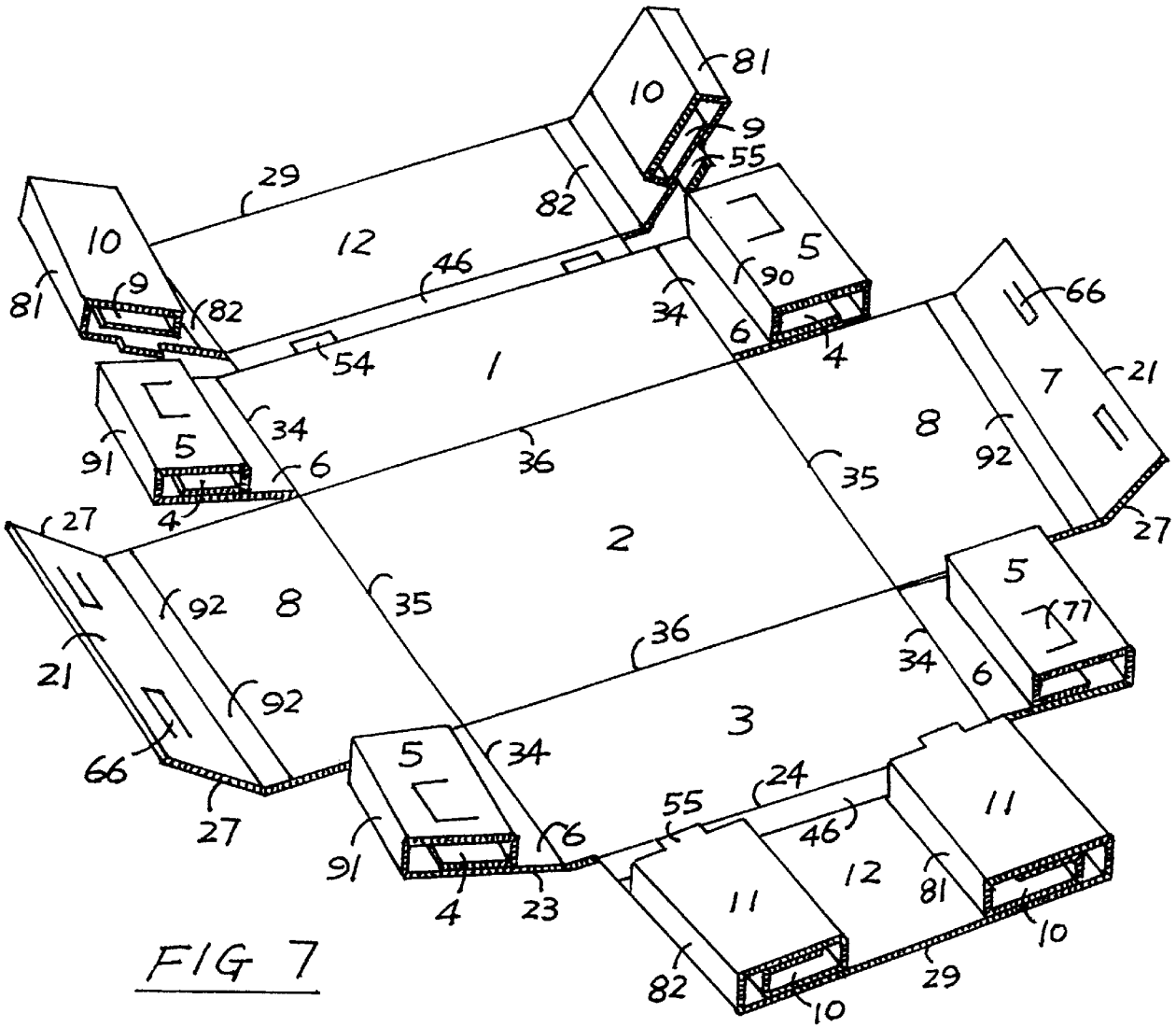
FIGS. 7 and 8 are perspective views showing the assembling process of the box with the support beams at all four sides.
Figure 8:
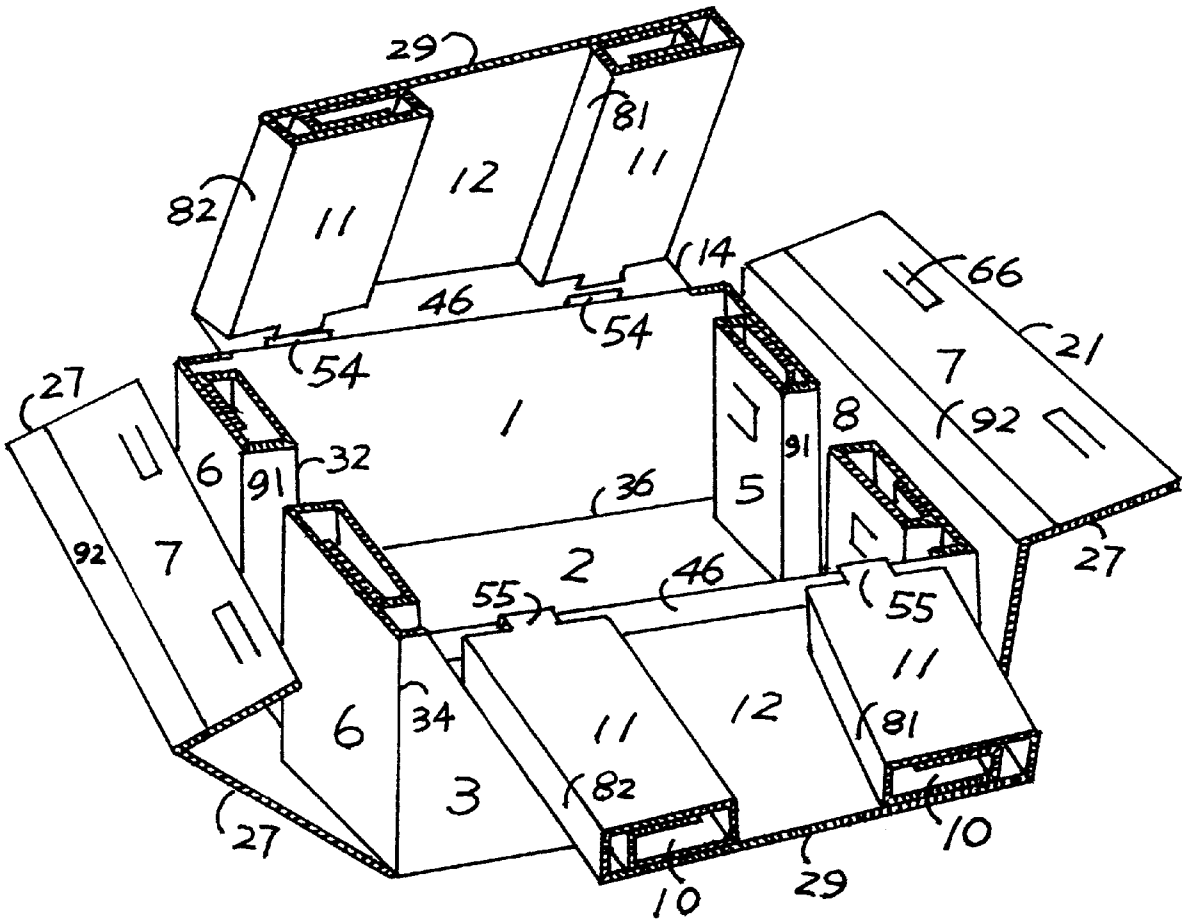

FIGS. 7 and 8 illustrate the assembling process of the box 89 of the second embodiment of the present invention. The end and side hollow support beams are formed as shown in FIG. 7. Then, the end hollow support beams are folded to be in upright positions and the end wall panels are folded over the end wall hollow beams and lock the end wall hollow beams by the locking insert tabs 66 and holding tabs 77. The locking tabs 55 on the filler beam portions of the additional filler beam panel get engaged with the locking slots 54 on the side-wall support surface 46. Then, the side-wall hollow beams are folded over against the side-wall panel 1 or 3 with the inner wall portion 12 serving the inner wall of the box 89.

As seen in FIG. 7, the orientations of the locking insert tabs 66 and holding tabs 77 are different, i.e., perpendicular with one another, as the box is opened up. In FIG. 8, the locking insert tabs and the corresponding holding tabs are oriented in the same direction as the box is being assembled. It can be understood that the locking insert tabs and holding tabs can be formed at any appropriate locations on the flap section and the support beam. Thus, it is different from the conventional tab-slot and tab-tab engagement that have to be near the corners of the box. The locking system of the present invention can be applicable to the connection of any two parallel panels so long as both panels may have corresponding portions to be cut out to form the tabs pointing in the same direction, and the wider tab may hold on the longer tab. This is shown in detail in FIGS. 9–12.

It can be understood that any handle-receptacle can be formed by die-cut. The handle-receptacle is normally located on the end wall section 8 of the end wall panel at a position that will be between the support beams constructed by the filler beam panels. Other kinds of apertures can be formed during the die-cutting to meet various needs for transporting fresh produce or storing sea food.

Figure 9:
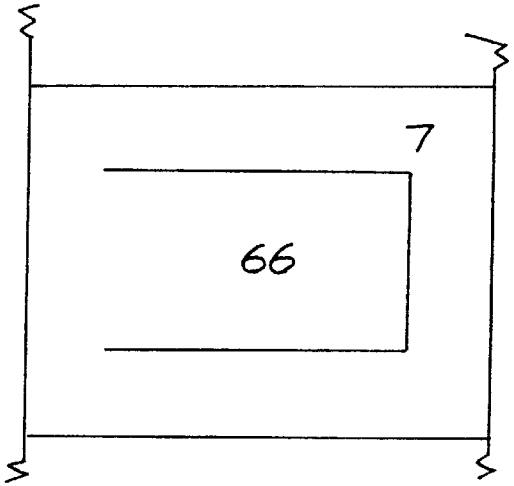
Figure 10:
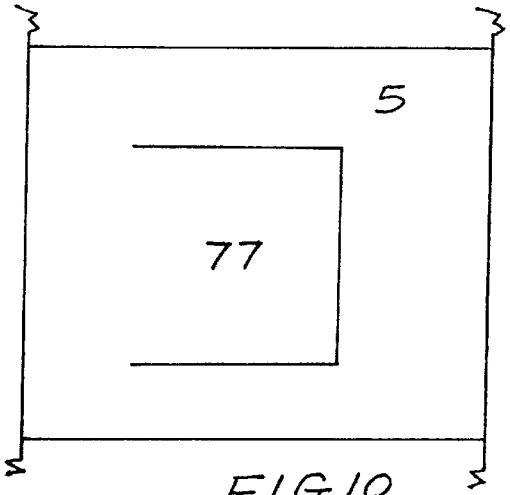

FIG. 9 shows the locking insert tab 66 of the novel locking system of the present invention. The holding tab 77 is shown in FIG. 10. As illustrated, the holding tab 77 is wider than the locking insert tab 66, while the insert tab 66 is longer than the holding tab 77. The insert tab 66 and holding tab 77 are, respectively, formed by cutting out a U-shape, at predetermined locations, on the flap section 7 and the inner beam section 5. Normally, they are defined by the predetermined U-shaped cut-through lines, and lie in the same plane with the surfaces of the respective flap section 7 and inner beam section 5.

During insertion, the locking insert tab 66 and holding tab 77 are pressed out of the flap section 7 and inner beam section 5, and the locking insert tab 66 slides through the opening of the pressing-away holding tab 77. Thereafter, the pressing is released, and the insert tab 66 is locked against the inner beam section 5 by return of the holding tab 77 due to the elastic property of the holding tabs. FIGS. 11 and 12 show the side view and plane view of such engagement. It can be understood that due to the reversed locking tab engagement, the novel locking system can tightly hold the assembled box in the predetermined shape. It is not easy to cause disengagement of the locking tabs by any accident.

The tabs must be pressed into the hollow beam and pulled out by hand in an opposite direction from the insertion.

Further, the locking insert tabs 66 and holding tabs 77 will return to their original positions when the box is disassembled. Each tab again appears to be a U-shaped cutting line either on the flap section 7 or on the inner beam section 5. These locking tabs form the integrity of the flap section or the inner beam section. Thus, they will not be easily distorted. Therefore, the foldable tote box having the novel locking system of the present invention can be reused many times. It can be understood that this locking system can be used in any kind of box, not necessarily in boxes of corrugated plastic materials. Nonetheless, the locking system may function better in the boxes of plastic materials or corrugated materials. With precise design, the holding tab 77 can be made a little bit wider than the insert tab 66, and the insert tab 66 is made a little bit longer than the holding tab 77 so as to assure the tight engagement thereof.

Figure 13:
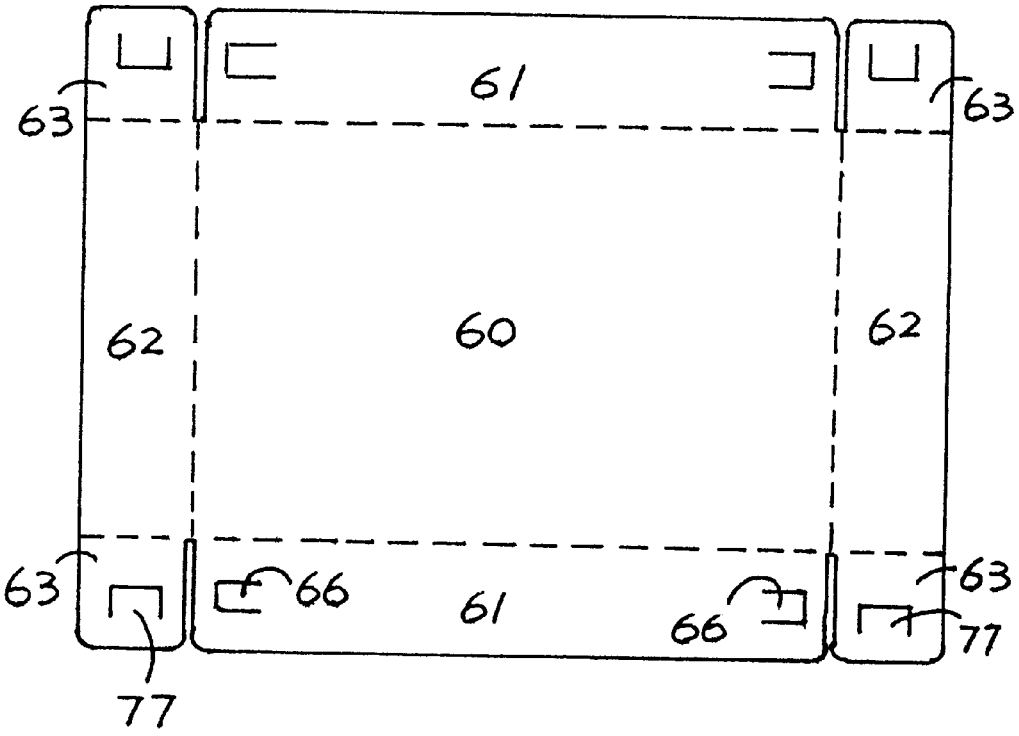
FIG. 13 is a plane view of a box cover board provided with the new locking system of the present invention.
Figure 14:
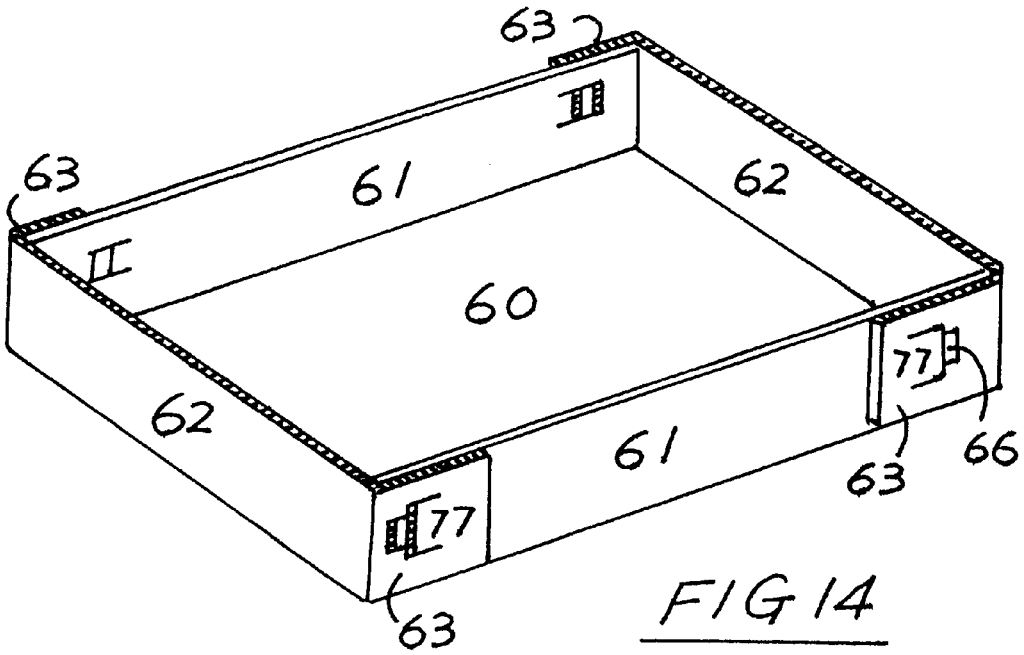
FIG. 14 is a perspective view of the box cover assembled with the new locking system of the present invention.

Furthermore, a cover piece can be provided with the same novel locking system. As shown in FIGS. 13 and 14, the cover piece is formed of nine panels including a top panel 60, two side panels 61, two end panels 62, and four corner panels 63 that are integrally connected to either end panels or side panels. The locking insert tabs are provided on the side panels if the corner panels are connected to the end panels. The locking insert tabs of the cover may be provided on the cover end panels if the corner panels are connected to the cover side panels.

Figure 15:
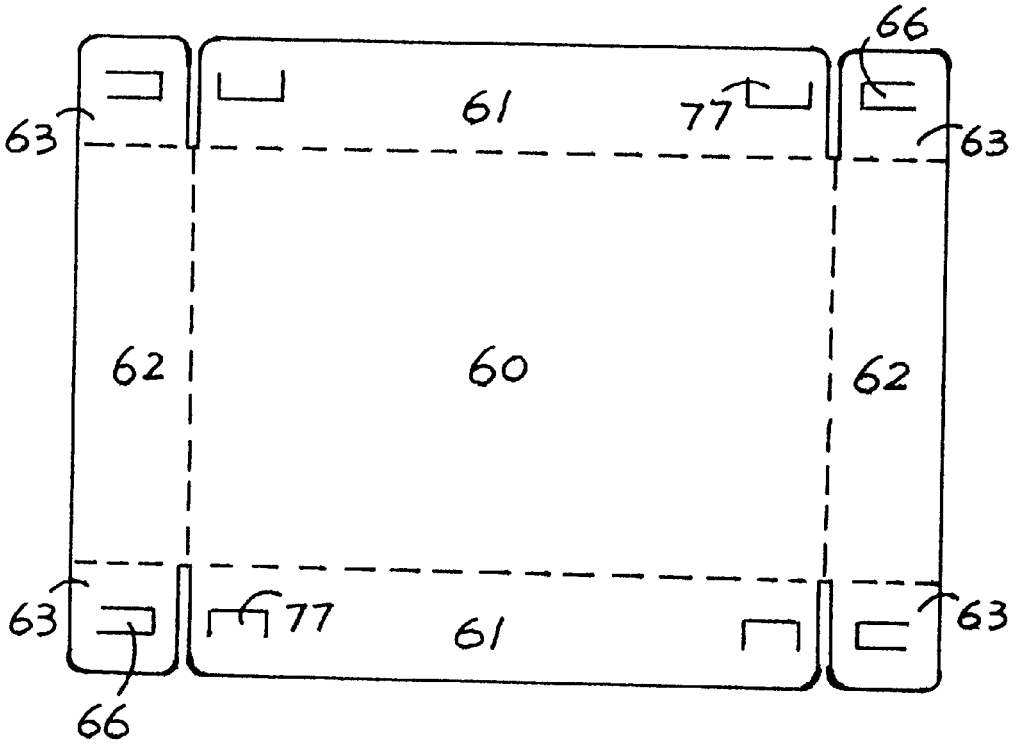
FIGS. 15 and 16 show a box cover with the locking insert tab and holding tab oriented in a different direction from the one in FIGS. 13 and 14.
Figure 16:
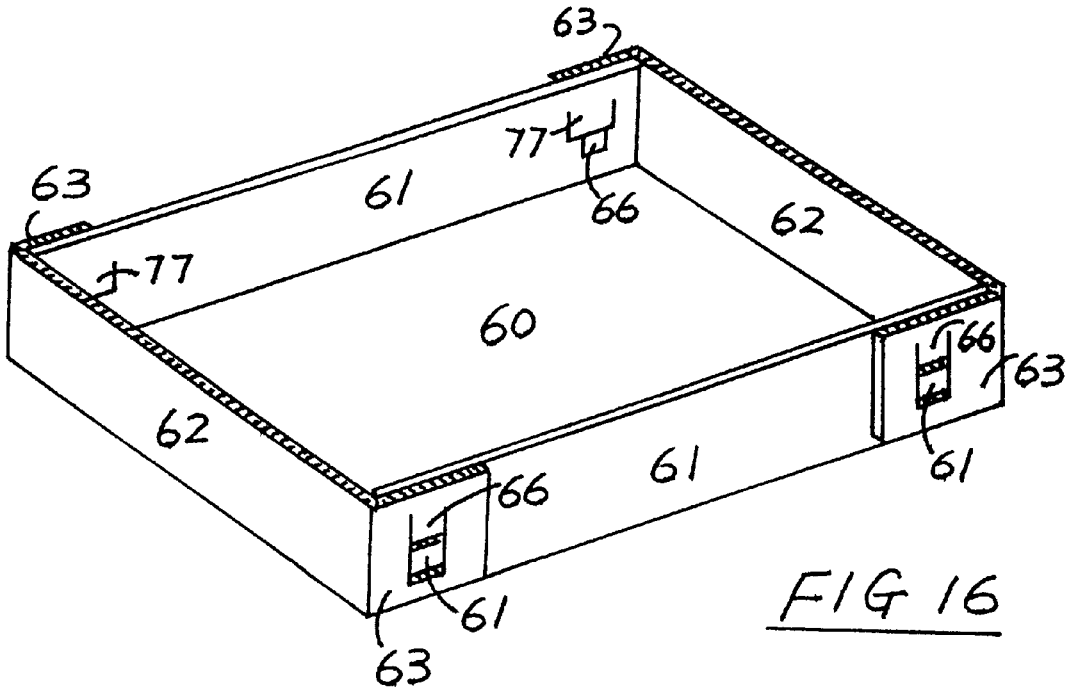

The variation of the box cover is shown in FIGS. 15 and 16. The orientations of the locking insert tab and holding tab in FIGS. 15 and 16 are different from the orientations of the tabs in FIGS. 13 and 14. They have been turned ninety degrees from the pointing direction toward the end wall panel, in FIGS. 13 and 14, to the pointing direction toward the top panel as in FIGS. 15 and 16. In the situation of FIGS. 15 and 16, the cover can be assembled and disassembled much easier, and can still hold the panels together. In either situation, should the side panels and end panels are enlarged in size, a simple foldable box with the new locking system can be obtained. The cover shown in FIGS. 13 to 16 would then represent such a box. The top panel is then the bottom panel of the box.

Figure 17:
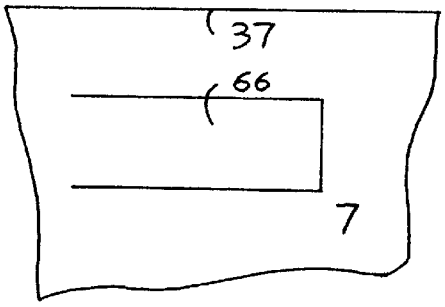
Figure 20:
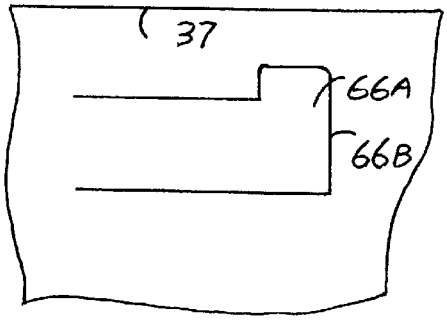
FIGS. 19–22 show the comparison of the tab arrangements of the locking system of the present invention.
Figure 18:
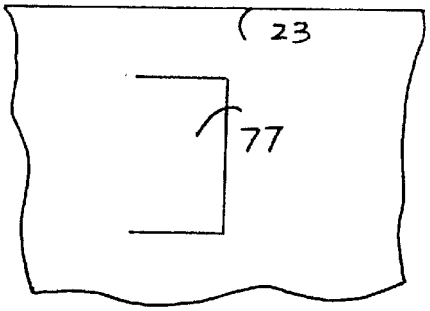
Figure 21:
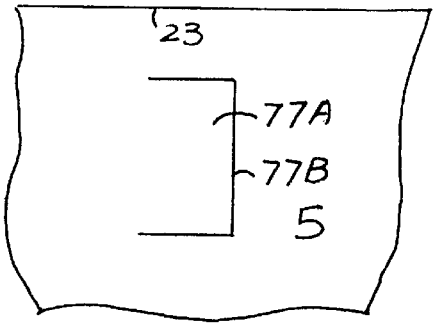
Figure 19:
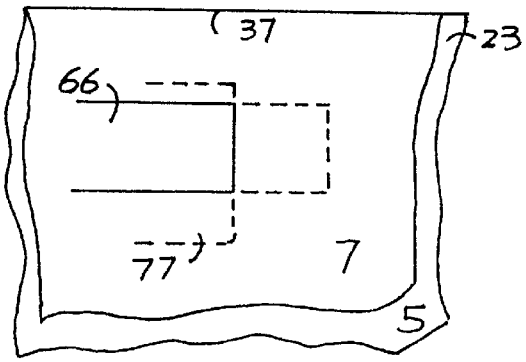
Figure 22:
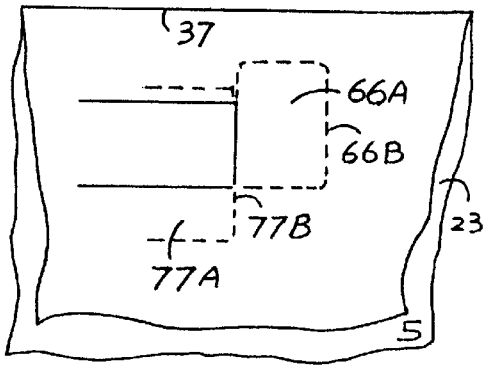

Moreover, FIGS. 17 to 19 show that the locking insert tab 66 is much narrower than the holding tab 77. The narrower insert tab 66 may assist easy insertion. In this situation, the holding of the engaged tabs 66 and 77 might not strong enough. Hence, a modified locking inset tab 66 with a turn over portion, i.e., a barbed head portion, can be used, as seen in FIGS. 20–22. The barbed portion 66A has its tip edge 66B smaller than the tip edge 77B of the holding tab 77A.

In any situation, the locking insert tab 66 and the corresponding holding tab 77 are oriented in the same direction when any two panels get connected together by such locking system. Such two-tab locking can be provided at any surfaces or locations on the two panels to be connected. Thus, such locking locations can be on side or end panels and corresponding corner panels as seen in FIGS. 13–16. The locking locations can also be on the flap section and support beams as shown in FIGS. 1–8.

The primary features of the box of the present invention has been described above. The box of the present invention has superior properties over the conventional boxes in terms of stable support. The one-piece board enables the easy storage of the board before the boxes are assembled for use. The durability of the corrugated plastic material gives the box of this invention the properties of moisture resistant, washable, repeatedly reusable, and capability of undertaking heavy load. The box of this invention can be used not only outdoor in raining or snowing days, but also in cold storage or refrigerated transportation of goods, especially the fresh produce, meat or seafood so as to preserve the quality of the fresh produce.

Further, the strong plastic material and the strong support beams of the box can protect the fresh produce in the box from being squeezed by outside force. The hollow support beams, either on the end walls of the box or on its four sides, may serve as cushion to absorb any impact on the box. The beams of the present box are hollow inside such that the direct sunshine might soften the outer end wall section 8 or outer beam section 6, but will not soften the inner beam sections of the support beam because the space inside beam and the flutes in the board will provide much better venting effect to prevent the support beam from being softened by the sunshine heat. Likewise, the hollow beams may prevent moisture immersion.

The novel locking system can assist the quick and smooth assembly of the box, and provide stable locking for the assembled box. The tabs of this locking cannot be unlocked by any accidental force. The tabs, however, can be easily released by hand only in the particular direction opposite to the insertion direction. The smooth appearance of the locking tabs of the present invention may give the box board better integrity.

I claim:

1. A foldable tote box comprising a one-pierce die-cut board of corrugated material, said board including a rectangular bottom panel having a predetermined length and width defined by its two side edges and two end edges; a pair of side-wall panels, each having a folding edge integrally connected to the side edge of the bottom panel and being folded along a first scored folding line to form the side-wall of the box, said side-wall panel having a top edge opposite to the folding edge and two end edges defining a width of the side-wall panel that defines a height of the box; a pair of filler beam panels connected to the end edges of each side-wall panel, each of said filler beam panels extending from said respective end edge of said side-wall panel along a second scored folding line and being folded to form a hollow support beam; a pair of end wall panels respectively integrally connected to and extended from the end edges of the bottom panel along third scored folding lines, each of said end wall panels including a flap section and an end wall section divided by first double scoring lines that define a support surface, wherein a pair of locking insert tabs is cut out in form of cutting lines on the flap section and engaged with a pair of holding tabs that is formed at predetermined locations on the filler beam panels so as to hold the support beams against the end wall section of the end wall panel when the box is assembled, and wherein each locking insert tab and its corresponding holding tab are oriented in the same direction.

2. The foldable box of claim 1, further comprising a pair of additional filler beam panels, each having an inner wall portion that is connected to the top edge of the side-wall panel and foldable along second double scoring lines that define a side-wall support surface, and a pair of side-wall filler beam portions being integrally connected to two opposite end edges of the inner wall portion along third double scoring lines and foldable to form two hollow support beams for the side-wall of the box, wherein a locking tab is formed at an up edge of the formed support beam and engages with a corresponding locking slot formed on the side-wall support surface when the box is assembled.

3. The foldable box of claim 1, wherein each of the filler beam panels is proportionally divided by fourth and fifth double scoring lines into outer beam section, inner beam section, and insert beam section, such that each of the filler beam panels can be folded to form a hollow support beam with the inner beam section provided with said holding tab of the locking system, said holding tab being in form of a U-shaped cutting line.

4. The foldable box of claim 2, wherein each of the side-wall filler beam portions of the additional filler beam panel is proportionally divided by sixth and seventh double scoring lines into at least three sections, such that the filler beam portions can be folded to form hollow support beams for side walls of the box.

5. The foldable box of claim 1, wherein the locking insert tab is generally in form of a U-shaped cutting line, and is longer than the holding tab, while the holding tab is wider than the locking insert tab such that upon pressing the locking insert tab and the holding tab away from their original positions, the holding tab is bent into the hollow beam and leaves an opening to let the insert tab slide through, and upon releasing the pressing, a portion of the insert tab sliding into the hollow beam is held by the holding tab against the hollow beam.

6. The foldable box of claim 4, wherein the locking tab is formed at the up edge of the filler beam portion near the inner wall portion, and the locking slot is at predetermined location on the side-wall support surface so that the locking tab of the filler beam portion protrudes through the locking slot when the board is folded to form the box.

7. The foldable box of claim 6, wherein the locking tab protrudes through the locking slot to serve as a stacking tab to hold an upper stacked box in place.

8. The foldable box of claim 6, wherein the locking slot has a size equal to the width of the side wall support surface between the second double scoring lines.

9. The foldable box of claim 1, further comprising a box cover piece that includes a top panel, two side panels, two end panels, and four corner panels that are integrally connected to the end panels, said cover piece having locking insert tabs on the side panels and holding tabs formed on the corner panels such that the locking insert tabs are pressed and inserted through the holding tabs and held by the holding tabs when the side panels and end panels are folded upward to form a cover.

10. The foldable box of claim 1, wherein the corrugated board is plastic board that has smooth surfaces on both sides, thereby defining therebetween a plurality of flutes such that the flutes in the beams are in an upright position when the box is assembled.

11. A one-piece board of a foldable tote box of corrugated material, said board comprising a rectangular bottom panel having a predetermined length and width defined by its two side edges and two end edges; a pair of side-wall panels, each having a folding edge integrally connected to the side edge of the bottom panel and being foldable along a first scored folding line to form the side-wall of the box, said side-wall panel having a top edge opposite to the folding edge and two end edges defining a width of the side-wall panel that defines the height of the box; a pair of filler beam panels connected to the end edges of each side-wall panel, each of said filler beam panels extending from said respective end edge of said side-wall panel and being foldable along a second scored folding line to form a hollow support beam; a pair of end wall panels respectively integrally connected to and extended from the end edges of the bottom panel and being foldable along third scored folding lines, each of said end wall panels including a flap section and an end wall section divided by first double scoring lines that define a support surface, wherein a pair of locking insert tabs is cut out in form of cuffing lines on the flap section and capable of engaging with a pair of holding tabs that is formed at predetermined locations on the filler beam panel to hold the support beams formed of the filler beam panels against the end wall section of the end wall panel when the box is assembled, and wherein each locking insert tab and its corresponding holding tab are oriented in the same direction.

12. The board of claim 11, further comprising a pair of additional filler beam panels, each having an inner wall portion that is connected to the top edge of the side-wall panel and foldable along second double scoring lines that define a side-wall support surface, and a pair of side-wall filler beam portions being integrally connected to two opposite end edges of each said inner wall portion along third double scoring lines and foldable to form two hollow support beams for the side-wall of the box, wherein a locking tab is formed at an up edge of the support beam and to be engaged with a corresponding locking slot formed on the side-wall support surface when the box is assembled.

13. The board of claim 11, wherein each of the filler beam panels is proportionally divided by fourth and fifth double scoring lines into outer beam section, inner beam section, and insert beam section, such that each of the filler beam panels can be folded to form a hollow support beam with the inner beam section provided with said holding tab of the locking system, said holding tab being in form of a U-shaped cutting lines.

14. The board of claim 12, wherein each of the side-wall filler beam portions of the additional filler beam panel is proportionally divided by sixth and seventh double scoring lines into at least three sections, such that the filler beam portions can be folded to form hollow support beams for side walls of the box.

15. The board of claim 14, wherein the locking insert tab is generally in form of a U-shaped cutting line, and longer than the holding tab, while the holding tab is wider than the locking insert tab such that upon pressing the locking insert tab and the holding tab away from their original positions, the holding tab can be bent into the hollow beam and leave an opening to let the insert tab slide through, and upon releasing the pressing, a portion of the insert tab sliding into the hollow beam can be held by the holding tab against inside surface of the hollow beam.

16. The board of claim 12, wherein the locking tab is formed at an up edge of the filler beam portion near the inner wall portion, and the locking slot is at predetermined location on the side-wall support surface so that the locking tab of the filler beam portion is capable of protruding through the locking slot when the board is folded to form the box, and wherein the locking slot has a size equal to the width of the side wall support surface between the second double scoring lines.

17. The board of claim 16, wherein the corrugated board is plastic board that has smooth surfaces on both sides, thereby defining therebetween a plurality of flutes such that the flutes in the beams are in an upright position when the box is assembled.

18. A locking system for a foldable tote box having a bottom panel, two end wall panels, two side-wall panels, and four corner panels, said locking system comprising a pair of locking insert tabs being cut out in form of cutting lines on each said end wall panel, and capable of engaging with a pair of holding tabs that is formed, respectively, at predetermined locations on the corresponding filler beam panels, wherein each locking insert tab and a corresponding holding tab are oriented in the same direction when the box is assembled, and the locking insert tab is longer than the holding tab, while the holding tab is wider than the locking insert tab such that the insert tab can be pressed and inserted through an opening created as the holding tab is pressed away from the corner panel during assembling of the box, and the holding tab can hold and lock the locking insert tab upon release of the pressing.

19. The locking system of claim 18, wherein the locking insert tab is generally in form of a U-shaped cutting line, and said holding tab is in form of a U-shaped cutting line, said locking insert tab and holding tab being in the same plane with the respective panels to form a smooth surface therewith before the tabs are pressed out of the respective original positions.

20. The locking system of claim 18, wherein the corner panels are filler beam panels that are foldable to form hollow support beams, two of the support beams being embraced by a flap section and end wall section of the end wall panel, and wherein a pair of said locking insert tabs is formed on the flap section and each of said holding tab is formed on each of the support beam such that the pair of the locking insert tabs gets engaged with the two holding tabs on the support beams embraced by the flap section.

21. The locking system of claim 18, wherein said engaged locking insert tab and holding tab point toward the end wall of the box as the box is assembled.

22. The locking system of claim 18, wherein said engaged locking inset tab and holding tab point toward the bottom of the box as the box is assembled.

23. The locking system of claim 20, wherein the engaged pair of the locking insert tabs point toward each other, and likewise the two holding tabs corresponding to the pair of the locking insert tabs point toward each other.

* * * * *